United States Patent [19]

Nanoia

[11] 4,002,115

[45] Jan. 11, 1977

[54] DOUBLE BALING PRESS

[76] Inventor: Maurice Nanoia, 1761-NW. 108th Ave., Pembroke Pines, Fla. 33026

[22] Filed: Feb. 6, 1975

[21] Appl. No.: 547,563

[52] U.S. Cl. ..... 100/53; 100/3; 100/220; 100/226; 100/255

[51] Int. Cl.[2] ..... B30B 15/16

[58] Field of Search ..... 100/220, 226, 225, 221, 100/224, 255, 53, 3; 200/61.69, 61.62, 61.76

[56] References Cited

UNITED STATES PATENTS

| | | | |
|---|---|---|---|
| 2,961,977 | 11/1960 | Coleman | 100/226 |
| 3,478,909 | 11/1969 | Charles | 100/226 X |
| 3,589,277 | 6/1971 | Gray | 100/226 X |
| 3,687,068 | 8/1972 | Loughran | 100/255 |
| 3,808,967 | 5/1974 | Fair et al. | 100/53 X |
| 3,863,561 | 2/1975 | Karls | 100/53 |

*Primary Examiner*—Billy J. Wilhite

[57] ABSTRACT

This invention pertains to a baling press incorporating a press box defining two side-by-side bale pressing chambers and a single press platen selectively, vertically, reciprocatingly operative in the upper portions of said two chambers, and a pair of doors in the front wall of the press box, hingedly operable in horizontal swinging movements for access into the respective bale pressing chambers. A hydraulic ram assembly, operatingly connected to the platen, is mounted atop a carriage which is manually movable along track means fixed atop the press box for selective alignment with either of the bale pressing chambers. Electric interlock means are provided to prevent operation of the ram unless both doors are completely closed and the platen is perfectly aligned vertically with one of the bale pressing chambers.

5 Claims, 6 Drawing Figures

DOUBLE BALING PRESS

BACKGROUND OF THE PRESENT INVENTION

This invention relates to bale-forming press boxes generally, and particularly relates to such a device in which the press box is elongated with a centrally disposed vertical septum which divides the interior thereof into two like chambers both of which are interiorly accessible through individual doors.

In the past, bale presses of this nature generally provided a single press chamber with a press platen vertically, reciprocatingly operative in the upper portion thereof. The press platen is operably connected to a hydraulic ram assembly, and both the platen and ram assembly are movable to an out-of-the-way position for the purpose of loading various materials through the top of the device into the single bale press chamber. After the materials are disposed in the chamber, the ram assembly and platen must be manually moved back into alignment with the bale press chamber and actuated to compact the materials.

With the double baling press of the present invention, the platen and ram assembly are moved from a position of vertical alignment with the first of said baling chambers to a position of vertical alignment with the second baling chamber when the first chamber is being loaded through the top with materials to be compacted. In this manner, the operator can load the first baling chamber while compacting materials in the second chamber and vice versa.

Another advantage of the double baling press is that different materials may be separated and individually baled in the respective chambers. For example, in super markets, corrugated cartons may be baled in one chamber and other trash materials may be baled in the other chamber, the corrugated carton bales have a cash value when individually baled. There is a great time-saving advantage in being able to separate materials for individual baling. Depending upon the size of the baling device, bales may be formed which weigh 200 to 400 lbs. and more, which represent a very substantial accumulation of corrugated cartons or the like, often substantially more than the storage capacity of many stores. Consequently, the bales are formed or built progressively in stages as the cartons are accumulated in relatively small numbers. Other trash must therefore be accumulated until a full bale has been formed, if a single baling machine is used, or the bales may be removed prematurely before being formed to their maximum sizes. This also represents additional time and labor resulting in additional costs.

The double baling press of the present invention, therefore, accomplishes the same time, labor and monetary savings as the use of two conventional single baling presses. However, the cost of the double baling press is very substantially less than the cost of two conventional baling presses as it operates from a single electric motor and hydraulic pumping means, hydraulic ram, carriage and platen.

OBJECTS AND ADVANTAGES OF THE PRESENT INVENTION

One of the principal objects of the present invention is to provide a double baling press providing two like baling chambers and a single platen and hydraulic ram assembly which is selectively movable into vertical alignment with either of said two chambers.

Another principal object of this invention is to provide such a double baling press which utilizes a single electric motor and hydraulic pumping means.

Yet another principal object of the instant invention is to provide electrical interlock means whereby said hydraulic pump, ram and platen cannot be operated unless both front doors are closed and the platen is in vertical alignment with one of the baling chambers.

DETAILED DESCRIPTION OF THE DRAWINGS

Figure 1:
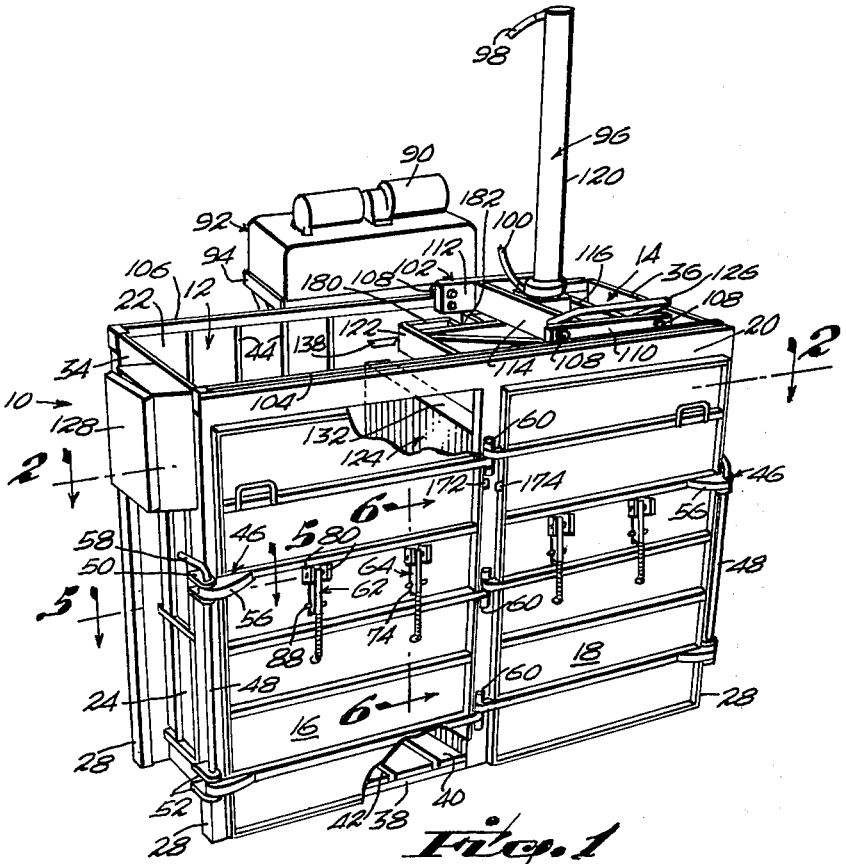
FIG. 1 is a front perspective view of a double baling press in accordance with the present invention.

With reference to the drawings in which like reference characters designate like or corresponding parts throughout the various views and with particular reference to FIG. 1, the double baling press of this invention is indicated generally at 10 and provides first and second baling chambers 12 and 14, a front opening door 16 and 18 for each chamber in a front wall 20, a back wall 22 and end walls 24 and 26. The frame for the device is composed generally of four tubular corner members 28, front and back, top tubular longitudinal members 30 and 32, top end plates 34 and 36 and a bottom frame assembly 38.

The end walls 24 and 26 of the press box are constructed in accordance with U.S. Pat. No. 3,687,068 which is directed to a single baling device, and will not be described in further detail. When one or both of the front doors 16 and 18 are opened, one or both of the end walls 24 and 26 are displaced outwardly and the lateral and longitudinal forces developed in the compacted bale or bales formed in one or both of the chambers 12 and 14 are released for easy removal thereof in accordance with the aforementioned patent. The bottom walls 40 of both chambers 12 and 14 and the back wall 22 along its length are provided with a series of parallel, aligned slots 42 and 44 for the purpose of passing baling wire around compacted bales in the chambers 12 and 14 as also disclosed in the aforementioned patent relative to a single baling chamber.

Figure 5:
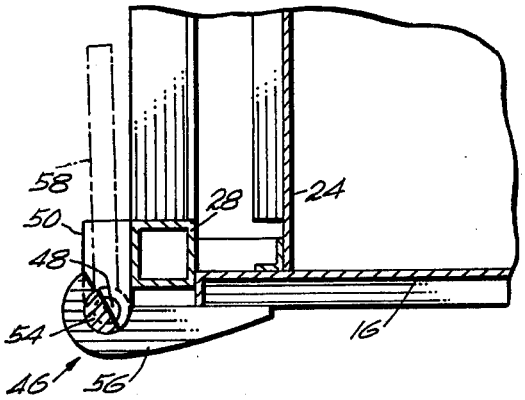
FIG. 5 is a fragmentary cross sectional view taken along the line 5—5 of FIG. 1.

With reference to FIGS. 1 and 5, each of the doors includes a latch means 46 comprised of a vertical rod 48, extending vertically through two pairs of spaced apart anchor plates 50 and 52. Intermediate each pair of plates 50 and 52, a cam member 54 in the form of a half disc, fixed to the rod 48, is adapted to engage in the arcuate bite of a hook member 56, fixed as by welding to one of the doors 16 or 18, in a first position. When an upper handle portion 58, extending at right angles to the rod 48 is moved through approximately 180° to a second position, the cam member 54 is disengaged from the bite of the hook member 56 and the door 16 or 18 is free to be swung to an open position by means of common hinges 60.

Figure 6:
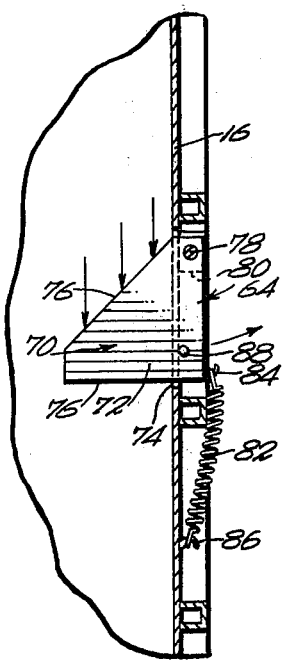
FIG. 6 is a fragmentary, vertical cross sectiona view taken along the line 6—6 of FIG. 1.
Figures 2, 3, 4:
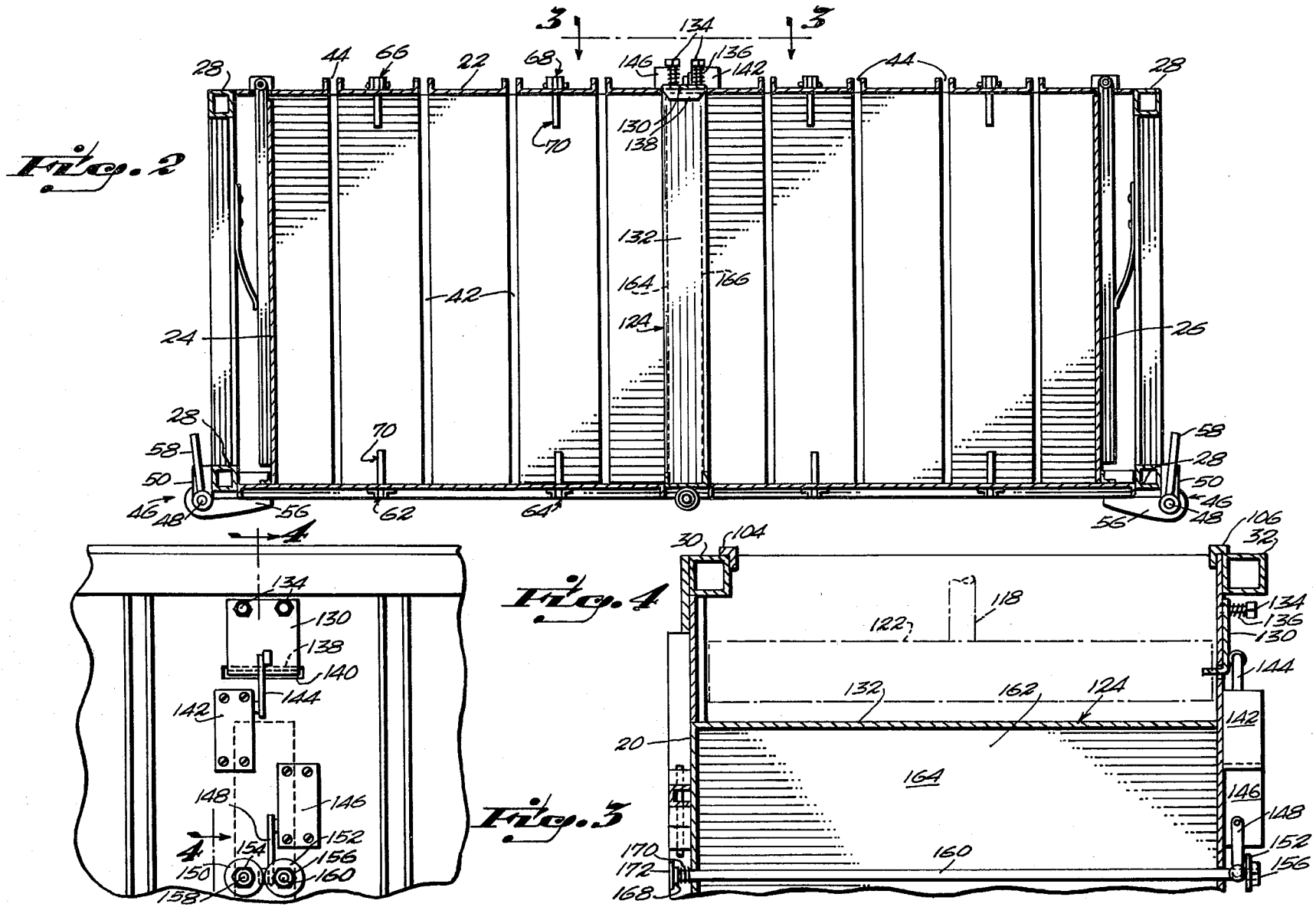
FIG. 2 is a longitudinal cross sectional view taken along the line 2—2 of FIG. 1.
FIG. 3 is an enlarged, fragmentary, elevational view of a central portion of the back of the press as seen along the line 3—3 of FIG. 2.
FIG. 4 is a vertical cross sectional view taken generally along the line 4—4 of FIG. 3.

Referring to FIGS. 1, 2 and 6, each door is provided with a pair of bale restrainer assemblies 62 and 64 in a spaced-apart relation generally at the vertical height of a bale formed in the respective chambers 12 and 14. A corresponding pair of bale restrainer assemblies 66 and 68 are formed in the back wall portion of each chamber 12 and 14.

With reference to FIG. 6, each bale restrainer assembly such as 64 is comprised of a generally triangular plate 70, the main portion 72 of which extends inwardly through a slot 74 in a door or back wall with a horizontal leg 76 positioned along the bottom of the plate 70 to restrain the tendency of a compacted bale to expand upwardly. The angular leg 76 of the plate 70 slopes upwardly and outwardly and the plate 70 is pivoted at 78 adjacent the top thereof between a pair of outer ears 80 to permit the plate to pivot outwardly when angular leg 76 is subjected to the compacting forces of materials in the chamber 12 or 14. Tension spring means 82 connect at 84 and 86 between the outer, lower end of each plate 70 and the outer surface of a door or back wall to return the plate 70 to a normal position as defined by a transverse pin 88 extending through the lower outer end of the plate 70 in engagement with the outer face of a door 16 or 18, or the back wall 22.

As seen in FIG. 1, an electric motor 90 and a self-contained hydraulic pumping unit 92 may be mounted on a frame 94 fixed to and extending outwardly from the rear top rail 32. A hydraulic ram assembly 96, connected to the pumping unit 92 by hoses 98 and 100, is vertically mounted centrally of a trolley carriage 102 which is adapted to travel along a pair of front and back tracks 104 and 106 on rollers 108 rotatably mounted on front and back plates 110 and 112. A pair of transverse plates 114 and 116 connect between the front and back plates 110 and 112. Fixed to the lower end of a piston rod 118, FIG. 4, from the ram cylinder 120, a horizontal platen 122 normally resides in the upper open end of either baling chamber 12 or 14 which are defined by the respective walls and doors, previously described, and a central vertical wall or septum 124. The septum 124 stops somewhat short of the top of the chambers 12 and 14 to permit the platen 122 which extends below the trolley carriage 102 to pass from a first position of vertical alignment with one baling chamber such as 14 to a similar second position relative to the other baling chamber 12 when in its retracted position.

A front hand grip means 126 is fixed relative to the trolley carriage 102 to permit convenient manual movement of said ram assembly, carriage and platen between the two positions.

A control box 128 may be mounted to one end of the press box 10 as illustrated or may be remotely located on a wall, for example. Electric interlock means are provided as a safety feature to prevent operation of the ram when it is not vertically aligned with either of the baling chambers 12 or 14 or if one or both of the doors 14 and 16 are open.

With reference particularly to FIGS. 2 and 3, a switch plate 130 is mounted on the back wall 22 centrally of the press 10, between the upper edge thereof and the top 132 of the septum 124. The plate 130 is held in place, adjacent its upper end, by a pair of screws 134 with compression springs 136 interposed between the heads thereof and the outer surface of the plate 130. An inwardly turned lip 138 from the lower end of the switch plate 130 extends through a slot 140 into the path of travel of the platen 122 as it is moved from one baling chamber 12 or 14 to the other. When the platen 122 contacts the lip 138 which is beveled, the switch plate 130 is pivoted outwardly against the pressure of the compression springs 136 tripping a switch 142 by means of a switch arm 144 in contact therewith to render the device inoperable.

With reference to FIGS. 3 and 4, a second interlock switch 146, fixed relative to the back wall 22, provides a switch arm 148, normally in contact with two large discs or washers 150 and 152, fixed as by nuts 154 and 156 to the outer rear ends of a pair of rods 158 and 160. As illustrated in FIG. 4, each rod 158 or 160 extends forwardly through the central space 162, defined between the side walls 164 and 166 of the septum 124, and extends outwardly of the front wall 20 terminating in a head 168. A compression spring 170, interposed between the head 168 and front wall 20, urges the rod 160 forwardly. Projections 172 and 174, FIGS. 1 and 4, from the respective doors 16 and 18 contact the heads 168 of the rods 158 and 160 when said doors are closed moving the rods rearwardly against the pressure of springs 170. The switch arm 148 contacts the inner sides of both washers 150 and 152 at their point of tangential contact and, consequently, if either door 16 or 18 is open or ajar, said door will permit its associated rod 158 or 160 to move forwardly under spring pressure causing one of the washers 150 or 152 to trip the switch arm 148 to render the device inoperable. Therefore, if one or both of the doors are open the device is inoperable.

The platen 122 includes a rear wall 180 which contacts the switch plate lip 138 at all times except when said platen is perfectly positioned over one of the baling chambers 12 or 14. Cut outs such as at 182 are provided in the platen to clear the bale restraining plates 70 in operation, however, said cut outs 182 are narrower than the length of the switch plate lip 138 and do not interfere with the proper operation thereof.

What is claimed is:

1. A baling press comprising a baling box having an open top and including a base defining a bottom box wall, and a main frame comprising a pair of spaced opposed end walls of a first common predetermined height, a front wall and a rear wall, said front wall and rear wall having upper end zones, and door means in said front wall; a vertical septum extending between the front and rear walls separating the box into two like side-by-side baling chambers, said septum extending upwardly above said bottom wall a distance less than said predetermined height of said end walls, said main frame including track means on the upper end zones of the front and rear walls and above said septum and extending across the septum, and a trolley carriage means including roller means in mating engagement with said track means for reciprocable movement along said track means across the top of said septum from a first position above one of the chambers to a second position above the other of said chambers, power actuated platen means operably supported by said trolley carriage for selective bi-directional vertical movement within either of said two side-by-side baling chambers; a first electrical interlock means to render said power actuated platen means inoperable except when said platen is vertically aligned with either of said side-by-side baling chambers, a second vertical interlock means to render said power actuated platen means inoperable if said door means are not closed, said door means comprising a main portion of said front wall, providing access means to the respective baling chambers for removal of compacted bales therefrom; and means normally suspending said power actuated platen means in the top portion of said baling box and means to actuate said platen means including a vertically disposed ram means centrally disposed atop said trolley carriage; and said first electrical interlock means comprises, a switch actuating plate pivotally attached to the outside face of said back wall for vertical alignment with said septum and being spaced thereabove in the path of travel of said carriage, and an inwardly extending horizontal lip portion on said switch actuating plate, extending through said back wall into the path of travel of said platen along said track means and a first electric switch means on the box including a portion operably engaged by said switch actuating plate and including biasing means normally urging said switch means into an "off" position and movable to a second current "on" position when said lip is moved outwardly by said platen.

2. The baling press as defined in claim 1 wherein said door means includes latch means for releasable engagement with a vertical corner post, comprising a portion of said main frame.

3. The baling press as defined in claim 1 wherein the length of said longitudinal lip is such that it is in contact with said platen at all times except when said platen is in vertical alignment with either one of said two baling chambers.

4. The baling press as defined in claim 1 including compression spring means to normally maintain said switch plate in said first position.

5. The baling press as defined in claim 1 wherein said second electrical interlock means comprises a pair of transverse rods slidably extending through the septum, said rods having back ends extending outwardly of said back wall, and including a second electrical switch, and said back ends including means attached thereto in mutual, separate engagement with said second electric switch to trip said second switch from a "off" position to an "on" position when both of said doors are closed, and abutment means on said door means, and each of said rods having a forward projection for engagement with said abutment means on said door means when said door means are closed, to slide said rod rearwardly, and biasing means normally urging said rods into a normal position, said biasing means being captivated by said rod and said front wall portion of said baling box.

* * * * *